United States Patent [19]

Kusayama

[11] Patent Number: 4,604,775

[45] Date of Patent: Aug. 12, 1986

[54] SEALING SLIDE FASTENER

[75] Inventor: Masahiro Kusayama, Kurobe, Japan

[73] Assignee: Yoshida Kogyo, K. K., Tokyo, Japan

[21] Appl. No.: 564,030

[22] Filed: Dec. 21, 1983

[30] Foreign Application Priority Data

Dec. 27, 1982 [JP] Japan ..... 57-234600

[51] Int. Cl.[4] ..... A44B 19/32

[52] U.S. Cl. ..... 24/389; 24/384; 24/416; 24/430; 24/429

[58] Field of Search ..... 24/384, 389, 418, 415, 24/416, 432, 435, 436, 429

[56] References Cited

U.S. PATENT DOCUMENTS

| | | | |
|---|---|---|---|
| 2,082,988 | 6/1937 | Taskila | 24/430 |
| 2,521,174 | 9/1950 | Krupp | 24/389 |
| 2,681,491 | 6/1954 | Snyder | 24/416 |
| 2,928,155 | 3/1960 | Kallio | 24/389 |
| 3,376,617 | 4/1968 | Snyder | 24/416 |
| 3,460,208 | 8/1969 | Spalding | 24/430 |
| 3,990,130 | 11/1976 | Hattori | 24/384 |

FOREIGN PATENT DOCUMENTS

| | | | |
|---|---|---|---|
| 33-5328 | 7/1958 | Japan . | |
| 623542 | 5/1949 | United Kingdom | 24/389 |

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A fluid-tight sealing slide fastener includes a pair of rows of coupling elements mounted respectively on inner opposite edges of a stringer tape, an elastomeric top stop mounted on the stringer tape around a terminal opening at ends of the rows of coupling elements, and a slider for taking the rows of coupling elements into and out of intermeshing engagement. The slider includes a slider body having a pair of upper and lower plates interconnected by a diamond, a presser having a plurality of pins extending through the upper plate, and a screw having a threaded shank threaded in a cylindrical body on the upper plate of the slider body and a head acting on the presser. When the slide fastener is closed and the screw is tightened, the pins are pressed against the top stop which is resiliently pressed against the lower plate and the diamond of the slider body to provide fluid-tight sealing between the top stop and the slider.

9 Claims, 9 Drawing Figures

SEALING SLIDE FASTENER

BACKGROUND OF THE INVENTION

1. Field of the Invention

The present invention relates to a sealing slide fastener, and more particularly to a fluid-tight sealing slide fastener having means for providing a sealing capability between a top stop and a slider against the leakage of air and water when the slide fastener is closed.

2. Prior Art

Various slide fasteners have been devised and put to use for providing a fluid-tight sealing capability against the leakage of air and water through the closed slit between adjacent edges. However, the prior fluid-tight slide fasteners have failed to give a sufficient sealing ability between a top stop and a slider when the slide fastener is closed.

Japanese Patent Publication No. 33-5328 published on July 23, 1958 discloses a fluid-tight sealing slide fastener. The disclosed slide fastener has a top stop made of an elastomeric material such as rubber and including a U-shaped body opening toward the bottom stop. The top stop has ridges on an upper surface thereof. When the slide fastener is closed by the slider, the slider is positioned on the top stop with the ridges thereon being compressed by an upper plate of the slider for rendering the top stop fluid-tight against the passage of air and water.

However, the known sealing slide fastener suffers various shortcomings. For example, the ridges on the top stop tend to wear due to abrasive engagement with the upper plate of the slider while the slider is repeatedly moved to open and close the slide fastener. The worn ridges cannot provide a sufficient fluid-tight sealing ability. The movement of the slider as it engages the top stop is relatively sluggish since the ridges on the top stop are resiliently pressed against the upper plate of the slider. An additional problem is that since the slider has no positive stop, the slider on the closed slide fastener is likely to slip off the top stop under a relatively strong force imposed on the slider, frequently allowing the slide fastener to be opened undesirably.

SUMMARY OF THE INVENTION

It is an object of the present invention to provide a sealing slide fastener having means for providing a high degree of fluid-tight sealing between a slider and a top stop.

Another object of the present invention is to provide a sealing slide fastener having a slider which can be slid over a top stop with a relatively small force and can be prevented from moving off the top stop after the slide fastener has been closed.

According to the present invention, a sealing slide fastener includes an elastomeric top stop mounted on a stringer tape at an end of a pair of rows of coupling elements, and a slider slidable along the rows of coupling elements to bring the latter into and out of mutual engagement, the slider including means on an upper plate of a slider body for pressing the top stop resiliently against a lower plate and a diamond of the slider body to thereby provide fluid-tight sealing between the top stop and the slider. The pressing means comprises a presser having a plurality of pins extending through holes in the slider's upper plate, and a screw threaded in a cylindrical body on the upper plate and having a head acting on the presser. Upon tightening the screw, the pins are pressed against the top stop to force the latter into resilient pressed engagement with the lower plate and the diamond. When the screw is loosened, the pins are lifted out of contact with the top stop, and the slider can smoothly slide along the rows of coupling elements to open or close the slide fastener.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
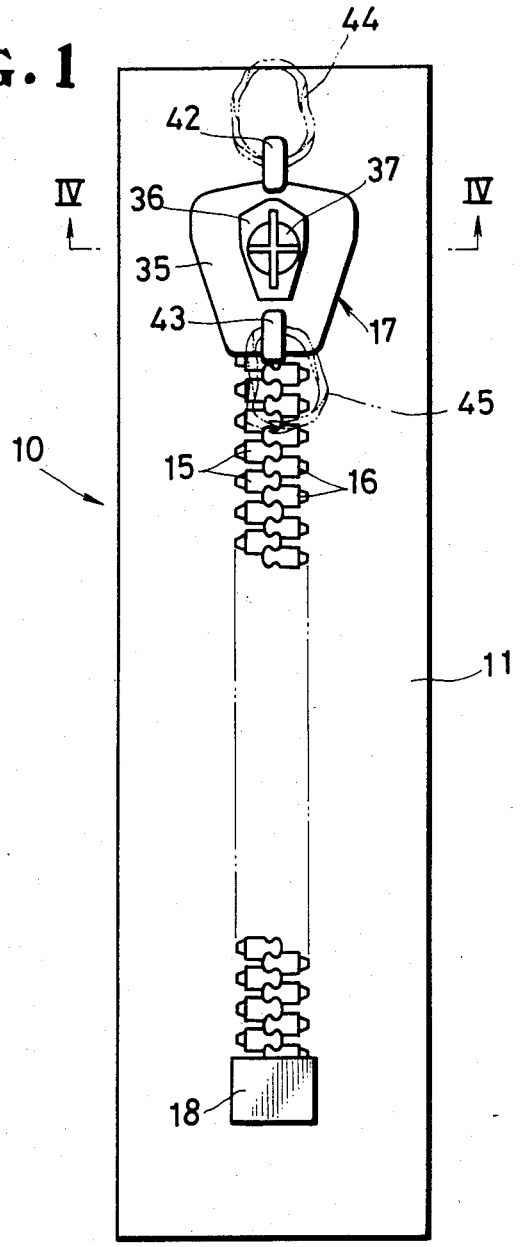
FIG. 1 is a plan view of a sealing slide fastener according to the present invention.

The principles of the present invention are particularly useful when embodied in a sealing slide fastener such as shown in FIG. 1, generally indicated by the reference numeral 10.

The sealing slide fastener 10 comprises an elongate water-resistant stringer tape 11 having a longitudinal opening or slit 12 (FIG. 3) defined by a pair of inner opposite beaded edges 13, 14. As shown in FIG. 1, a pair of rows of coupling elements 15, 16 is secured to the inner opposite edges 13, 14, respectively. A slider 17 is slidably mounted on the rows of coupling elements 15, 16. The sealing slide fastener 10 also has a bottom stop 18 attached at a lower end of the rows of coupling elements 15, 16 and a top stop 19 attached at an upper end of the rows of coupling elements 15, 16. The top and bottom stops 19, 18 serve to stop the sliding movement of the slider 17 along the rows of coupling elements 15, 16. The stringer tape 11 additionally has a pair of slider stops 20 (FIGS. 3 and 6) positioned one on each side of the top stop 19 for stopping the slider 17.

Figure 4:
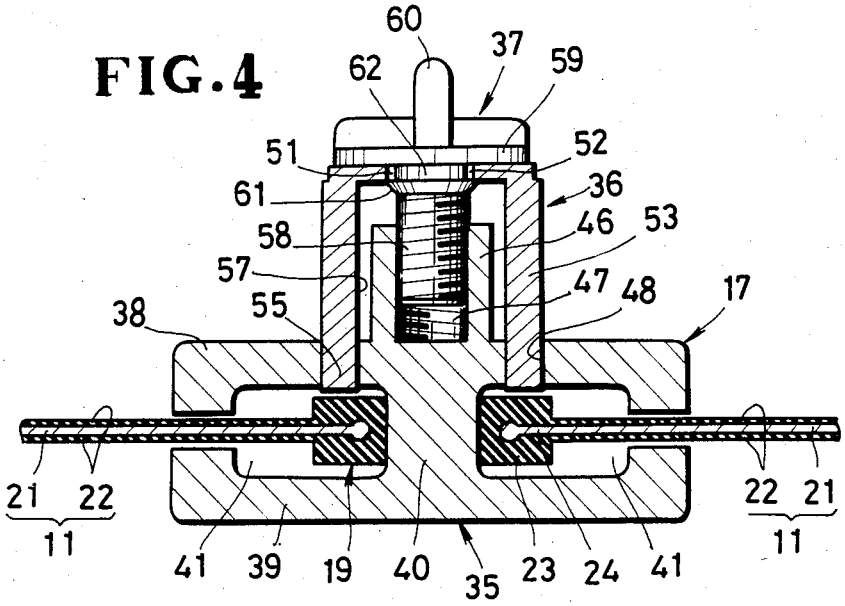
FIG. 4 is an enlarged cross-sectional view taken along line IV—IV of FIG. 1.
Figure 5:
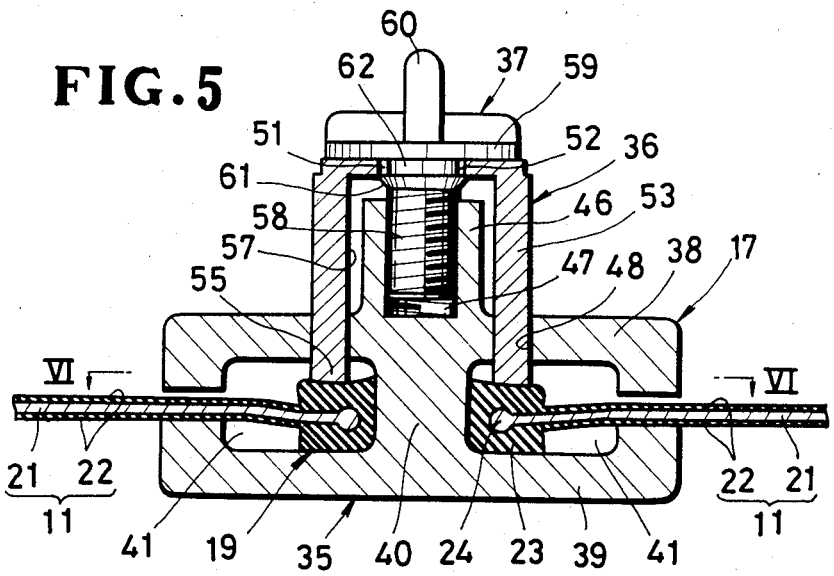
FIG. 5 is a view similar to FIG. 4, showing the slider fastened to the top stop by tightening a screw.

As illustrated in FIGS. 4 and 5, the water-resistant stringer tape 11 is composed of a woven or knit tape core 21 and a pair of soft sealing layers 22, 22 coated on the face and back, respectively, of the tape core 21.

The coupling elements 15, 16 are made of synthetic resin injection-molded on marginal edge portions including the beaded edges 13, 14 of the stringer tape 11.

Figure 3:
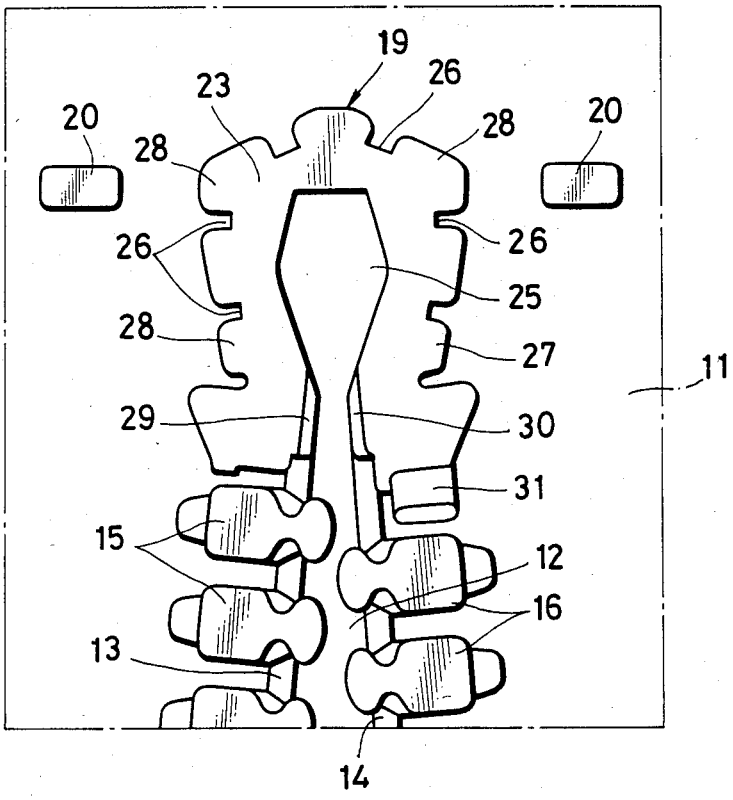
FIG. 3 is an enlarged plan view of a portion around a top stop of the sealing slide fastener of the invention.
Figure 6:
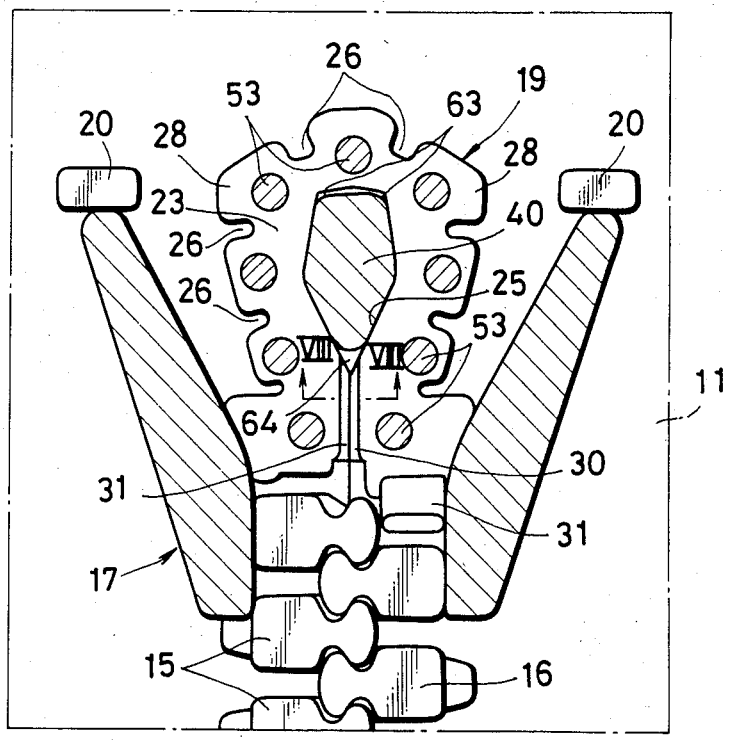
FIG. 6 is a cross-sectional view taken along line VI—VI of FIG. 5.
Figure 8:
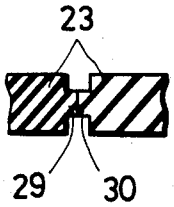
FIG. 8 is an enlarged cross-sectional view taken along line VIII—VIII of FIG. 6.

The top stop 19 is made of an elastomeric material such as rubber and has a substantially horseshoe-shaped body 23 extending around a peripheral edge 24 (FIGS. 4 and 5) of a terminal opening 25 which communicates with the opening 12 when the slide fastener 10 is opened, as shown in FIG. 3. The top stop body 23 is disposed in surrounding relation to the peripheral edge 24 and raised on the face and back of the stringer tape 11, as illustrated in FIGS. 4 and 5. As shown in FIGS. 3 and 6, the top stop body 23 has a plurality of recesses 26 defined in an outer peripheral edge 27 thereof remote from the terminal opening 25 and opening radially outwardly away from the terminal opening 25, thus providing a plurality of peripherally spaced seats 28. As illustrated in FIGS. 3, 6 and 8, the top stop body 23 has a pair of confronting edges 29, 30 of reduced thickness disposed adjacent to the lower ends of the top stop body 23 and extending respectively in alignment with the beaded edges 13, 14 of the stringer tape 11. A reinforcing body 31 of synthetic resin is bonded or otherwise fixed to one of the lower ends of the top stop body 23 in a space immediately upward (as shown in FIGS. 3 and 6) of the uppermost one of the row of coupling elements 16 which is located slightly below the uppermost one of the other row of coupling elements 15. The reinforcing body 31 serves to prevent the stringer tape 11 from being deformed immediately above the uppermost one of the coupling elements 16.

The bottom stop 18 and the slider stops 20 are made of an elastomeric material such as rubber.

Figure 2:
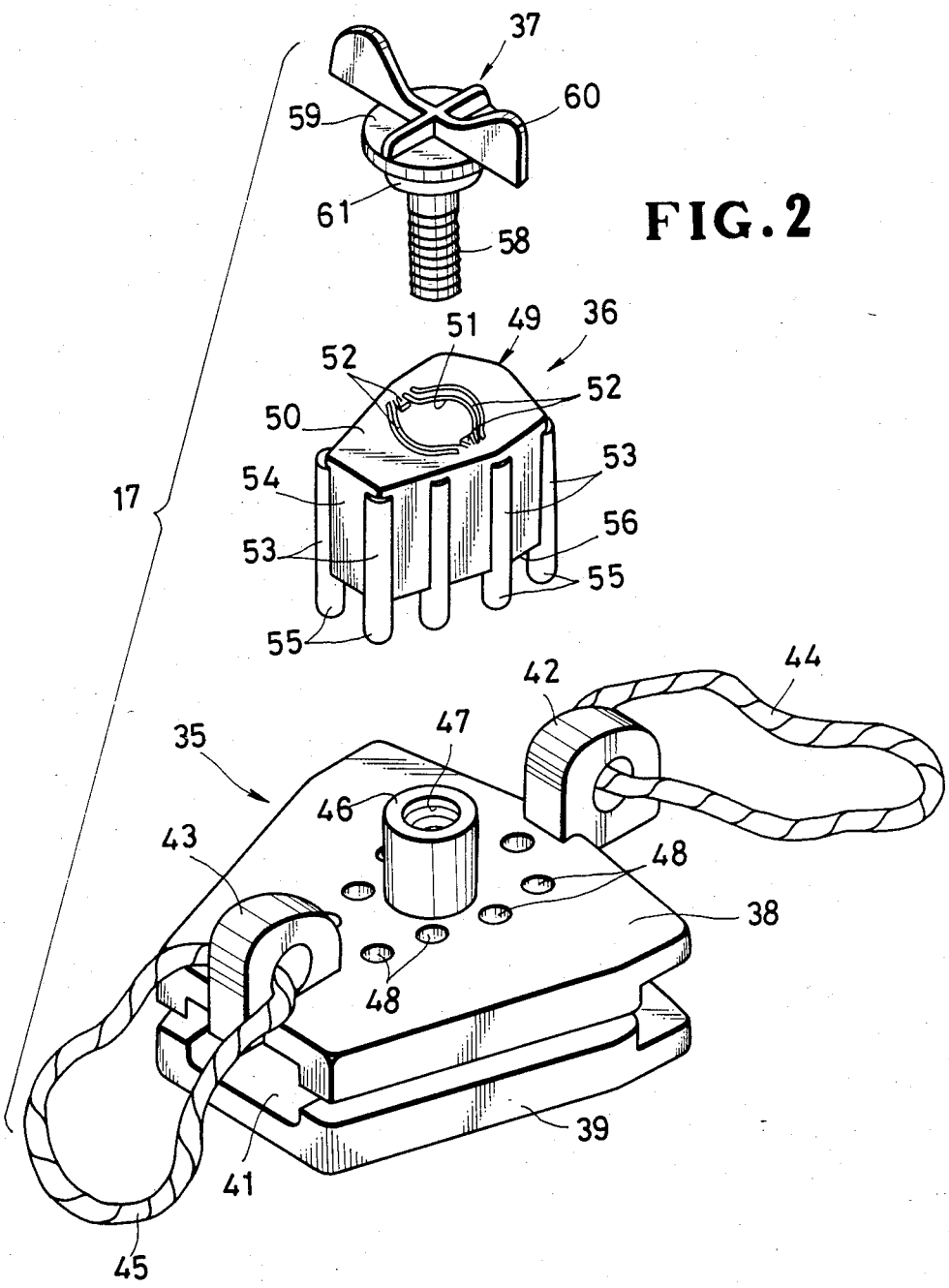
FIG. 2 is an enlarged exploded perspective view of a slider of the sealing slide fastener shown in FIG. 1.

As shown in FIG. 2, the slider 17 basically comprises a slider body 35, a presser 36, and a screw 37. The slider body 35 is composed of a pair of upper and lower flanged plates or wings 38, 39 interconnected by a diamond or separator post 40 (FIGS. 4 and 5) to define a generally Y-shaped guide channel 41 between the upper and lower flanged plates 38, 39 for guiding the rows of coupling elements 15, 16 therethrough. The upper plate 38 has a pair of pull string attachments 42, 43 fixed thereto at opposite ends thereof in longitudinal alignment with the diamond 40. A pair of pull strings 44, 45 is coupled to the pull string attachments 42, 43, respectively, for enabling the user to pull the slider 17 along the rows of coupling elements 15, 16. A cylindrical body 46 is integrally mounted on the upper plate 38 in substantial alignment with the diamond 40 and has an internally threaded hole 47. The upper plate 38 has a plurality of through-holes 48 disposed in angularly spaced relation around the cylindrical body 26 and the diamond 40 and communicating with the guide channel 41 as shown in FIGS. 4 and 5. The through holes 48 are positioned in a substantially horseshoe-shaped pattern which is approximately the same as the horseshoe-shaped top stop body 23.

The presser 36 has a presser body 49 in the form of a hollow cap having an upper panel 50 and an open bottom. The presser body 49 has a central through-opening 51 in the upper panel 50 and having a diameter larger than that of the internally threaded hole 47 in the cylindrical body 46. The upper plate 50 also has locking ridges 52 projecting into the opening 52. The presser body 49 includes as many vertical pins 53 as there are through-holes 48 in the upper plate 38 of the slider 35. The vertical pins 53 are integral with a side wall 54 of the presser body 49 and have lower ends 55 projecting downwardly of a lower edge 56 of the side wall 54. The vertical pins 53 are positioned in angularly spaced relation for insertion in the through-holes 48 in the slider's upper plate 38. When the slide fastener 10 is fully closed (FIG. 1), the vertical pins 53 are vertically (perpendicularly to the general plane of the slide fastener 10) aligned with the respective seats 28 of the top stop body 23 for engagement therewith, as shown in FIG. 6. As shown in FIGS. 4 and 5, the presser body 49 has an inner recess 57 opening through the open bottom thereof and communicating with the central opening 51 in the upper panel 50.

Figure 7:
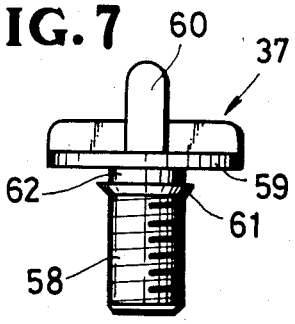
FIG. 7 is a front elevational view of the screw of the slider.

The screw 37 is basically composed of an externally threaded shank 58 threaded into the internally threaded hole 47 in the cylindrical body 46 on the slider's upper plate 38, and a head 59 attached to an upper end of the shank 58 and having a thumb wing 60. The shank 58 includes an annular flange 61 axially spaced from the head 59 with an annular groove 62 defined therebetween, as better shown in FIG. 7.

The screw 37 is rotatably mounted on the presser 36 and is retained thereon against removal. To attach the screw 37 to the presser 36, the externally threaded shank 58 of the screw 37 is forcibly inserted through the hole 51 into the inner recess 57 in the presser body 49 until the locking ridges 52 are snapped into the annular recess 62, as shown in FIGS. 4 and 5. The presser 36 with the screw 37 mounted thereon can be mounted on the slider body 35 as follows: The externally threaded shank 58 is threaded into the internally threaded hole 47 in the cylindrical body 46 on the slider's upper plate 38 with the lower ends 55 of the vertical pins 53 of the presser 36 being fitted respectively in the through-holes 48 in the slider's upper plate 38. Therefore, the lower ends 55 of the vertical pins 53 can be moved into the guide channel 41 out of the holes 48 or retracted into the holes 48 out of the guide channel 41 by turning the shank 58 in a direction into or out of the hole 47 in the cylindrical body 46.

Operation of the sealing slide fastener 10 is as follows: When it is desired to close the slide fastener 10, the screw 37 is loosened to retract the presser 36 until the lower ends 55 of the pins 53 are lifted up to a level out of contact with the coupling elements 15, 16 and the top stop 19. Then, the pull string 44 is pulled to move the slider 17 in a direction to take the rows of coupling elements 15, 16 into mutual intermeshing engagement. With the pins 53 out of contact with the coupling elements 15, 16 and the top stop 19, the slider 17 can be slid smoothly without suffering from undue sluggish movement. When the slider 17 reaches the top stop 19 after having closed the slide fastener 10, the slider body 35 abuts against the slider stops 20 and an upper edge of the terminal opening 25. At this time, there are gaps 63, 64 between the peripheral surface of the diamond 40 and the peripheral edge of the terminal opening 25, as shown in FIG. 6. Furthermore, the top stop 19 is spaced from the lower plate 29 of the slider body 35 as illustrated in FIG. 4. Consequently, no fluid-tight sealing capacity is provided between the slider 17 and the top stop 40 when the slider 17 is simply located at the top stop 40.

Now, the screw 37 is tightened to move the presser 36 downwardly until the lower ends 55 of the pin 53 engage the seats 28 of the top stop 19 and press the latter down against the lower plate 39 of the slider body 35. Since the top stop 19 is elastic, it is resiliently pressed against the slider's lower plate 39 tightly with no gap left therebetween, as shown in FIG. 5. The inner peripheral edge of the top stop 19 is elastically deformed laterally into intimate contact with the entire peripheral surface of the diamond 40, eliminating the gaps 63, 64. The confronting edges 29, 30 of the top stop 19 are also brought into pressed contact with each other by the flanged upper plate 38 of the slider body 35 which engages the lower ends of the top stop 19 as shown in FIG. 6. When the top stop 19 is thus pressed down by the presser 36, therefore, no air or water finds its way between the top stop 19 and the slider 17 through the slide fastener 10 from one side to the other. The slider 17 is firmly held in position by the top stop 19 pressed by the presser 36 and hence is prevented from being accidentally displaced under undue forces applied to the slider 17 in a direction to open the slide fastener 10.

For opening the slide fastener 10, the screw 37 is loosened to retract the presser 36 until the lower ends 55 of the pins 53 are raised to a level out of contact with the top stop 19 and the coupling elements 15, 16. Then, the pull string 45 is pulled to move the slider 17 along the rows of coupling elements 15, 16 to disengage the latter. The slider 17 can be moved smoothly since the pins 53 do not engage the top stop 19 and the coupling elements 15, 16.

The top stop 19 is of a thickness which is substantially the same as that of the coupling elements 15, 16 to allow the slider 17 to move uninterruptedly over the top stop 19.

Figure 9:
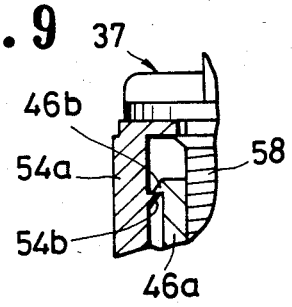
FIG. 9, appearing with FIG. 3, is a fragmentary cross-sectional view of a modified slider.

FIG. 9 shows a modification in which a cylindrical body 46*a* on the slider body has a radially outwardly directed locking prong 46*b* and a side wall 54*a* of the presser body has a radially inwardly directed locking prong 54*b* engageable with the locking prong 46*b*. With this modified arrangement, the presser body is prevented by interlocking engagement of the prongs 46*b*, 54*b* from being detached from the slider body when the screw shank 58 is loosened for moving the slider. Therefore, once the slider body 35, the presser 36, and the screw 37 are assembled, they are retained together against disassembly.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A sealing slide fastener comprising:

(a) a stringer tape having a pair of inner opposite edges defining a longitudinal opening therebetween, said stringer tape having a terminal opening communicating with said longitudinal opening;

(b) a pair or rows of coupling elements mounted on said inner opposite edges, respectively;

(c) an elastomeric top stop mounted on said stringer tape around said terminal opening at an end of said pair of rows of coupling elements; and (d) a slider slidably mounted on said rows of coupling elements for taking the latter into and out of mutual intermeshing engagement, said slider including a slider body having a pair of upper and lower plates and a diamond interconnecting said upper and lower plates and defining a guide channel therebetween for passage therethrough of said rows of coupling elements, and means on said upper plate for pressing said top stop resiliently against said lower plate and said diamond when said slider is located on said top stop, said means comprising a presser having a plurality of pins extending through said upper plate and means for pushing said pins against said top stop.

2. A sealing slide fastener according to claim 1, said upper plate having a plurality of through-holes positioned around said diamond and communicating with said guide channel, said pins extending through said through-holes, respectively, and movable into and out of said guide channel by said pushing means, said pushing means comprising a cylindrical body mounted on said upper plate and having an internally threaded hole and a screw having an externally threaded shank threaded in said internally threaded hole and having a head acting on said presser.

3. A sealing slide fastener according to claim 2, said presser including an upper panel having an opening and locking ridges projecting into said opening, and a side wall on which said pins are mounted, said externally threaded shank having an annular groove in which said locking ridges are disposed.

4. A sealing slide fastener according to claim 2, said cylindrical body having a first locking prong and said side wall having a second locking prong engageable with said first locking prong for retaining said presser on said slider body.

5. A sealing slide fastener according to claim 1, said top stop being composed of a substantially horseshoe-shaped body for receiving said diamond therein, said horseshoe-shaped body having a plurality of angularly spaced seats against which said pins are pressed, respectively.

6. A sealing slide fastener according to claim 5, said horseshoe-shaped body having a pair of inner opposite edges engageable with each other to close said terminal opening when said slider is positioned on said top stop.

7. A sealing slide fastener according to claim 1, said top stop having a thickness which is substantially the same as that of said coupling elements.

8. A sealing slide fastener according to claim 1, said upper plate having a pair of attachments at opposite ends thereof in substantially longitudinal alignment with said diamond and a pair of pull strings connected to said attachments, respectively.

9. A sealing slide fastener according to claim 1, said stringer tape having a pair of slider stops positioned one on each side of said top stop for being abutted by said slider.

* * * * *